US005836826A

United States Patent [19]

Haraminac

[11] Patent Number: 5,836,826

[45] Date of Patent: Nov. 17, 1998

[54] MACHINE FOR MAKING STAR NAILS

[75] Inventor: John Haraminac, North Royalton, Ohio

[73] Assignee: Star Technologies, Inc., Hinesville, Ga.

[21] Appl. No.: 782,405

[22] Filed: Jan. 14, 1997

[51] Int. Cl.[6] ..... B21G 3/00

[52] U.S. Cl. ..... 470/117; 470/136; 470/154; 470/168; 470/176; 470/180; 72/206

[58] Field of Search ..... 470/110, 117, 470/121, 129, 130, 131, 133, 136, 140, 154, 156, 157, 161, 164, 168, 169, 176, 179, 180, 192, 195, 196; 72/187, 206

[56] References Cited

U.S. PATENT DOCUMENTS

| | | | |
|---|---|---|---|
| 3,204,265 | 9/1965 | Fiekers et al. | 470/156 |
| 4,365,445 | 12/1982 | Watson | 470/164 |
| 4,472,956 | 9/1984 | Leistner | 92/103 |
| 4,755,091 | 7/1988 | Potucek et al. | 411/452 |
| 4,800,746 | 1/1989 | Potucek | 72/372 |
| 4,833,906 | 5/1989 | Potucek | 72/206 |
| 5,081,732 | 1/1992 | Steinhilber | 470/40 |
| 5,140,715 | 8/1992 | Monacelli | 470/40 |
| 5,542,886 | 8/1996 | Scott et al. | 470/136 |

FOREIGN PATENT DOCUMENTS

| | | | |
|---|---|---|---|
| 3340406 | 5/1985 | Germany | 470/133 |

*Primary Examiner*—Joseph J. Hail, III
*Assistant Examiner*—Ed Tolan
*Attorney, Agent, or Firm*—Joseph C. Mason, Jr.

[57] ABSTRACT

A machine makes nails having a star-shaped transverse cross-section by sequentially feeding conventional nails into a form roller station defined by a plurality of form rollers that are radially arrayed with respect to a centerline of the nails. Circumferentially spaced notches formed about the periphery of each form roller engage the heads of the conventional nails as the form rollers rotate and pull the nails into forming relation with the form rollers. The notches also prevent formation of the nail heads. A plurality of circumferentially spaced concavities formed in the form rollers prevents forming of the work-hardened points of the nails. The nails are sequentially delivered from a bowl feeder to an indexer that inverts the nails. A pair of rotatably mounted augers transfer the nails from the indexer to a nail-gripping device that holds each nail until its head is engaged by the nail-engaging notch in each of the form rollers. The form rollers are rotated by a gear train that begins with a ring gear rotated by a motor, and the gear train enables adjustment of the rotational phase of the form rollers so that they may be maintained in rotational phase with one another.

7 Claims, 10 Drawing Sheets

MACHINE FOR MAKING STAR NAILS

BACKGROUND OF THE INVENTION

1. Field of the Invention

This invention relates, generally, to nail-making machines. More particularly, it relates to a machine that makes nails having a star-shaped cross-section.

2. Description of the Prior Art

The advantages of nails having a star-shaped transverse cross section, vis a vis conventional nails having circular transverse sections are well known. See, for example, U.S. Pat. No. 4,755,091 to Potucek et. al.

U.S. Pat. No. 4,800,746 to Potucek discloses a machine for making nails having a star-shaped cross section. Wire, from a large coil, is continually fed into the machine. The machine roll forms the wire into a star-shaped configuration, cuts the wire into individual nail-length sections, and forms a nail head by smashing a portion of the wire that was skipped during the forming process. The star-shaped wire is formed by using five form rollers arrayed in a star pattern in radial relation to the longitudinal axis of the wire. A notch is formed in the periphery of each roller to skip a short section of each wire so that the skipped section may be smashed to form a nail head. The machine is laid out horizontally, i.e., the wire passes horizontally from station to station as it is configured, cut, and headed.

There are a number of shortcomings with such machine. Perhaps the most significant limitation is the need to head the nails; the time required to accomplish the heading prevents the machine from operating at economical speeds. For example, the earlier machine could produce about 200 nails per minute, but in the nail industry that is an unacceptably slow rate. If the machine is operated at a faster rate, such as 300 nails per minute, it fails after only a few hours of operation due to the excessive forces acting upon it. Moreover, the form rollers employed in the machine fail after unacceptably short lifetimes as well.

What is needed, clearly, is a machine for making star nails at a much faster rate. A need also exists for a machine that will not fail after only a few hours of operation.

However, in view of the art at the time the present invention was made, it was not obvious to those of ordinary skill in this art how the needed apparatus could be provided.

SUMMARY OF THE INVENTION

The longstanding but heretofore unfulfilled need for an apparatus that overcomes the limitations of the prior art is now met by a new, useful, and nonobvious machine for making nails having a star-shaped transverse cross-section. The novel machine includes an indexing means adapted to releasably and simultaneously engage a plurality of nails having flat heads and substantially circular transverse cross-sections. It further includes a bowl feeder that performs a hopper function and that delivers said nails having flat heads and a substantially circular transverse cross section in sequential fashion to the indexing means. The indexing means is adapted to sequentially receive the nails in a first upright position and to invert them into an inverted position where their respective heads are positioned below their respective points. A forming station including a plurality of rotatably mounted form rollers is positioned in downwardly spaced relation to the indexing means, and a transfer means for displacing each nail away from the indexing means and delivering each nail to the forming station is positioned between the indexing means and the forming station. Each form roller of the plurality of form rollers has a nail head-receiving notch formed in its periphery to engage a head of each nail delivered to the forming station by the transfer means and to pull each nail into forming relation with the plurality of form rollers. A nail collection means is positioned below the forming station so that a nail having a formed shank drops into said collection means under the force of gravity when it is released by the plurality of forming rollers.

It is a primary object of this invention to provide a star nail-making machine that produces nails at an economical rate of speed.

Another important object is to provide such a machine that operates for extended periods of time without shutting down.

Still another object is to provide a better star-shaped nail than heretofore available.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
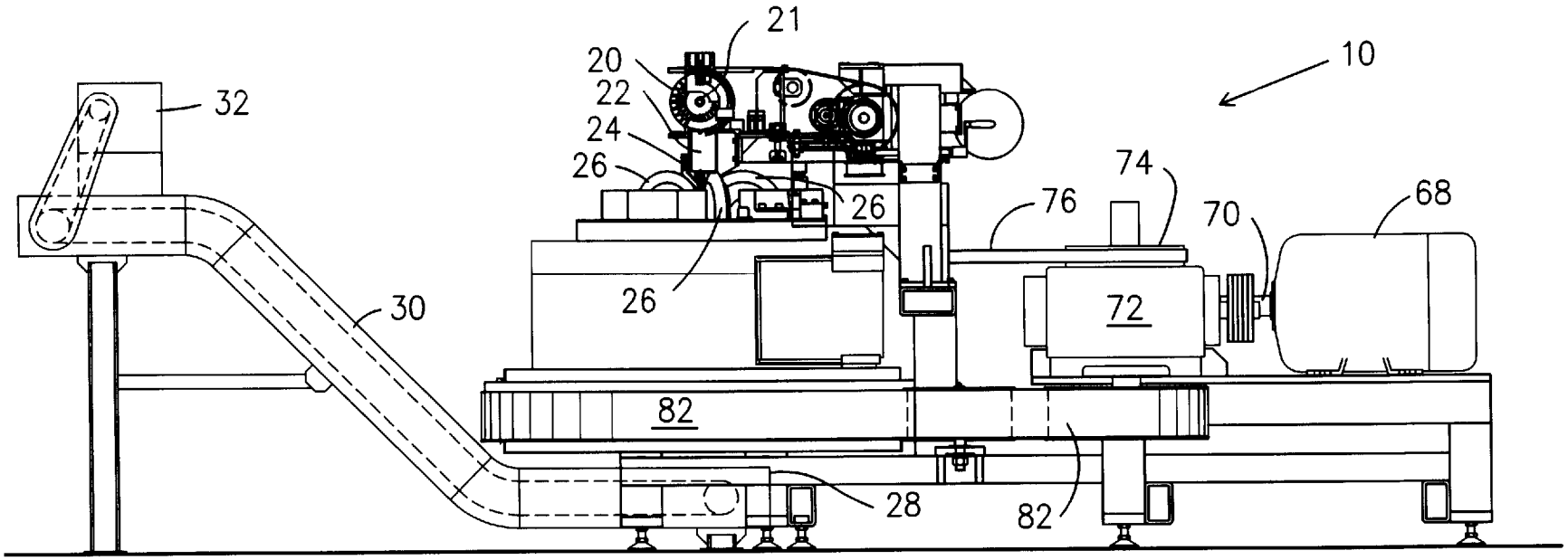
FIG. 1 is a side elevational view of an illustrative embodiment of the novel machine.
Figure 2:
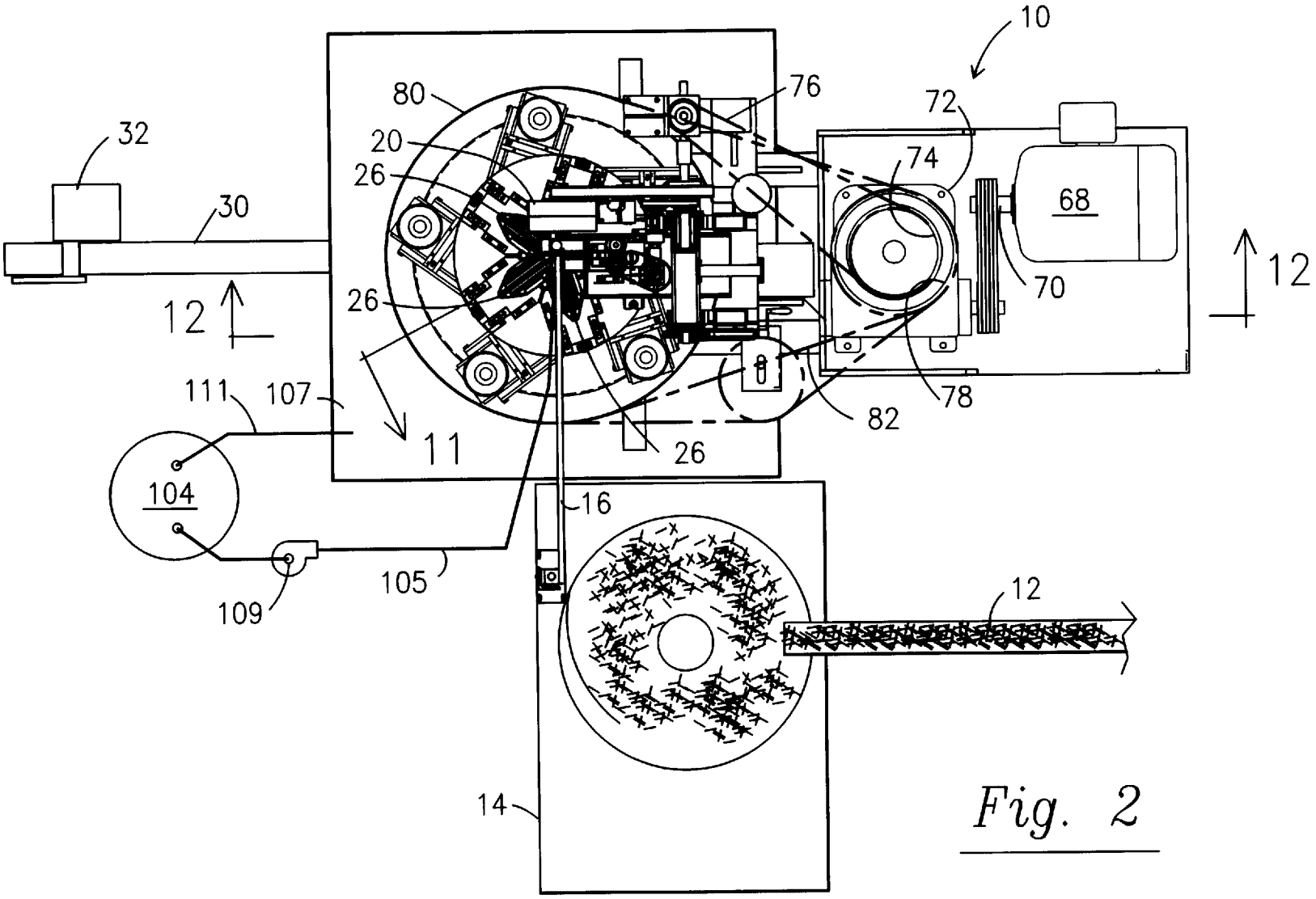
FIG. 2 is a top plan view thereof.
Figure 3:
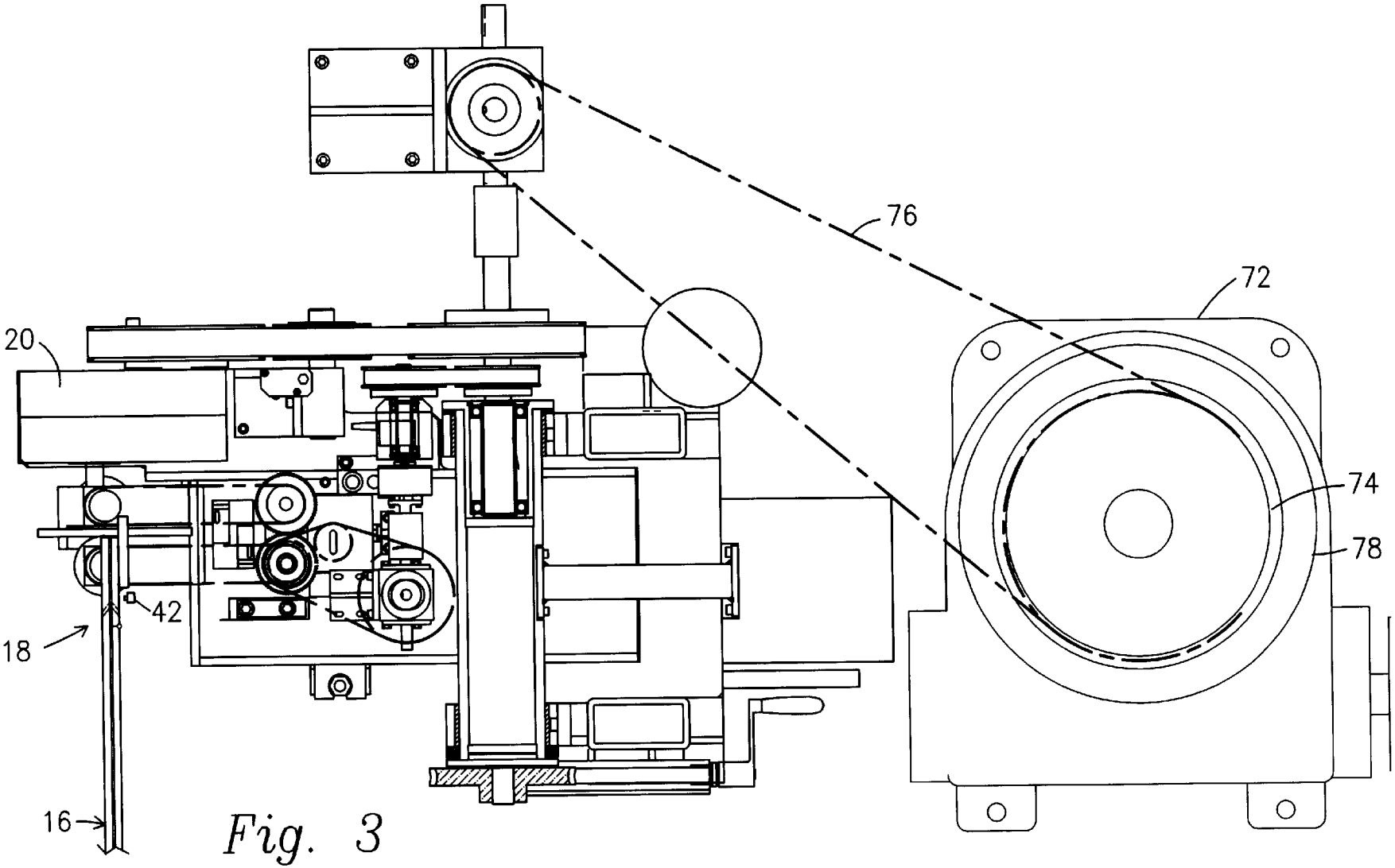
FIG. 3 is an enlarged top plan view of a part of FIG. 2.

Referring now to FIGS. 1–3, it will there be seen that an exemplary embodiment of the invention is denoted as a whole by the reference numeral 10.

Machine 10 includes a supply conveyor 12 (FIG. 2) that continuously delivers flat-headed nails having a shank of substantially circular transverse cross-section, i.e., conventional nails, to an elevated hopper means 14. Hopper means 14 is a bowl feeder of the well-known type, i.e., it is used in applications where conventional nails need to be delivered sequentially to a work station. For example, it is used to package nails in a collated arrangement for subsequent use in an automatic nail gun. Essentially, it includes an archimedes screw-like structure around its periphery that feeds the nails into a slot that circumscribes the bowl. The respective shanks of the nails enter into the slot, but the nailheads cannot pass therethrough; as a result, the nails orient themselves in a suspended orientation with the heads thereof positioned above the points thereof, i.e., with their respective flat heads disposed in a horizontal plane and their respective shanks descending from said heads in a vertical plane.

Nails exiting bowl feeder 14 are fed single file into a commercially-available downwardly inclined discharge chute 16; the downward inclination of chute 16 and a vibration applied thereto by a vibrating means, not shown, cooperate to deliver the nails sequentially to a novel nail accelerator means 18, FIGS. 3 and 3*a*, disclosed in detail hereinafter.

Accelerator means 18 delivers the nails to novel indexer/inverter means 20 (FIGS. 1–3), disclosed in detail hereinafter; means 20 inverts each nail so that its head is directly below its point.

A nail transfer means 22 (FIG. 1), also disclosed in detail hereinafter, then engages the head of an inverted nail and drives it downwardly into a gripping means 24; the gripping means holds the shank of the nail, leaving its head exposed.

A plurality of form rollers, collectively denoted 26, are radially positioned about a vertical axis; gripping means 24 holds each nail in the same vertical axis. Thus, the form rollers are disposed radially with respect to a centerline of each nail that is formed by them, as perhaps best understood in connection with the plan view of FIG. 2.

Each form roller 26 is notched at circumferentially spaced intervals as disclosed in detail hereinafter, and the nail head of a nail held by gripping means 24 is engaged by one of the nail head-receiving notches as said form rollers rotate about their respective axes of rotation. This pulls the shank of the nail into the forming area where it is formed into a star-shaped transverse cross section (see FIGS. 8 and 9). When the forming process has been completed, the nails drop under the influence of gravity into a collection area 28 (FIG. 1) directly beneath the forming station. They are then delivered by a conventional conveyor means 30 to a packing station 32.

Figure 11:
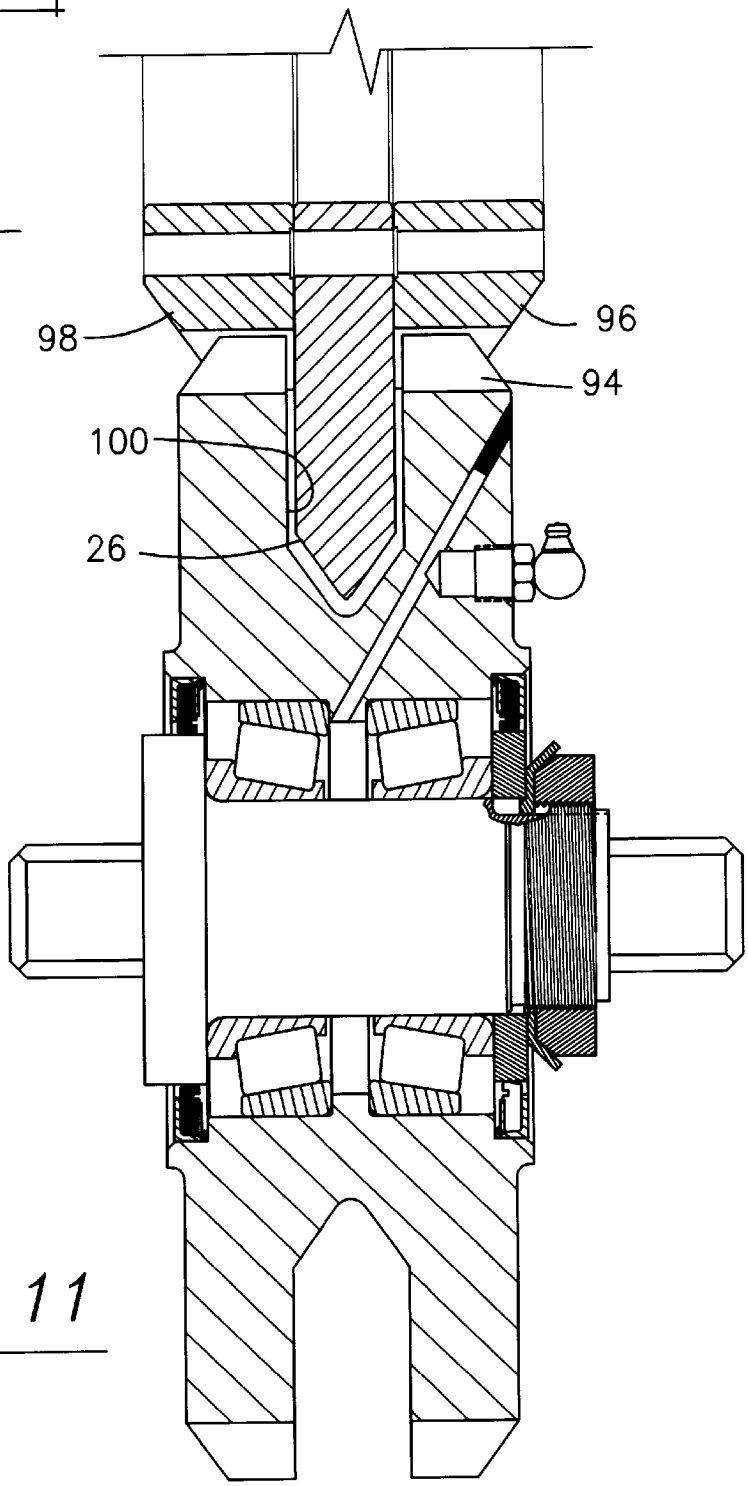
FIG. 11 is an enlarged sectional view taken along line 11—11 in FIG. 10.
Figure 10:
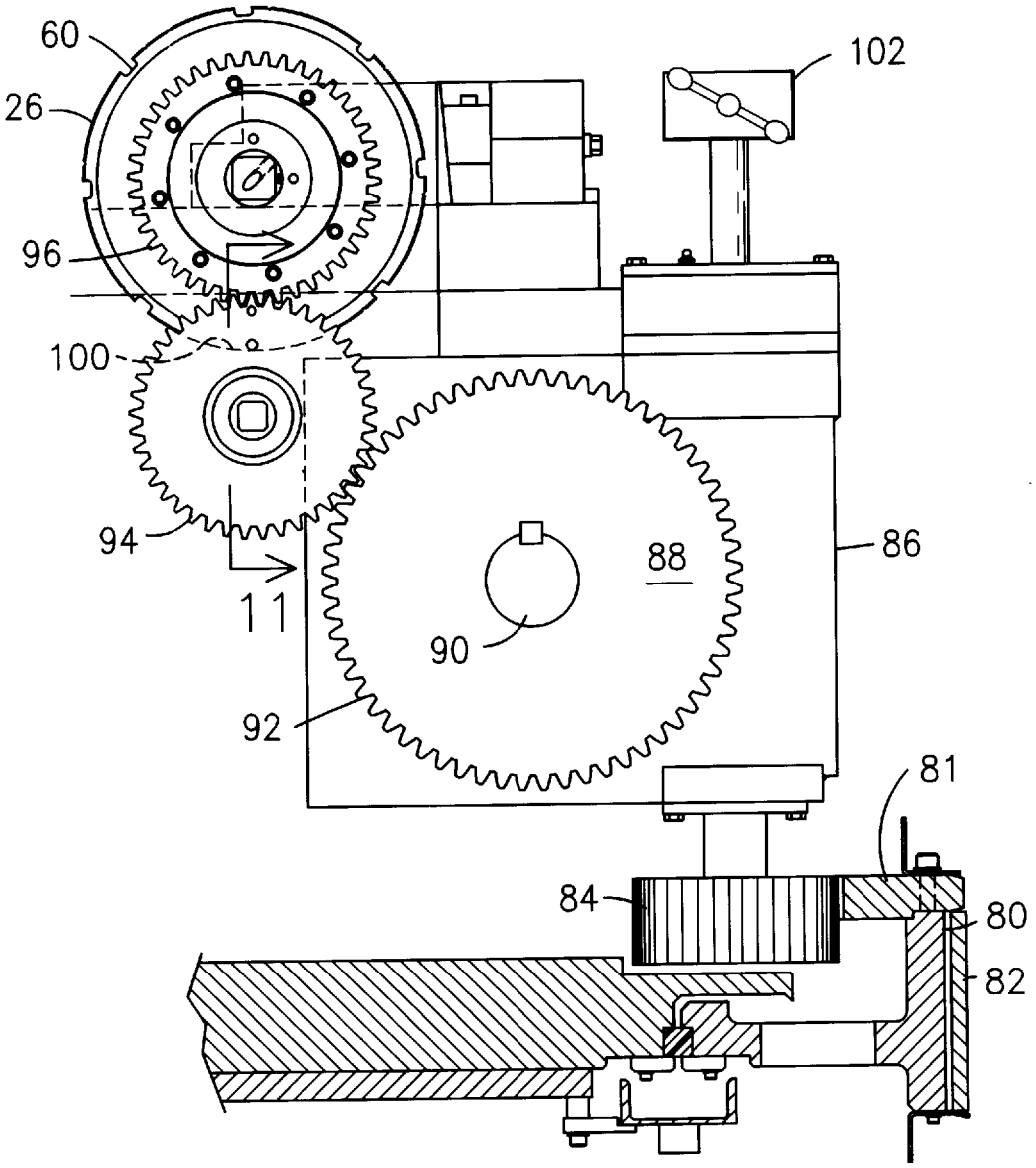
FIG. 10 is a partially sectional, elevational view of a gear train that interconnects the form rollers to a ring gear.
Figure 12:
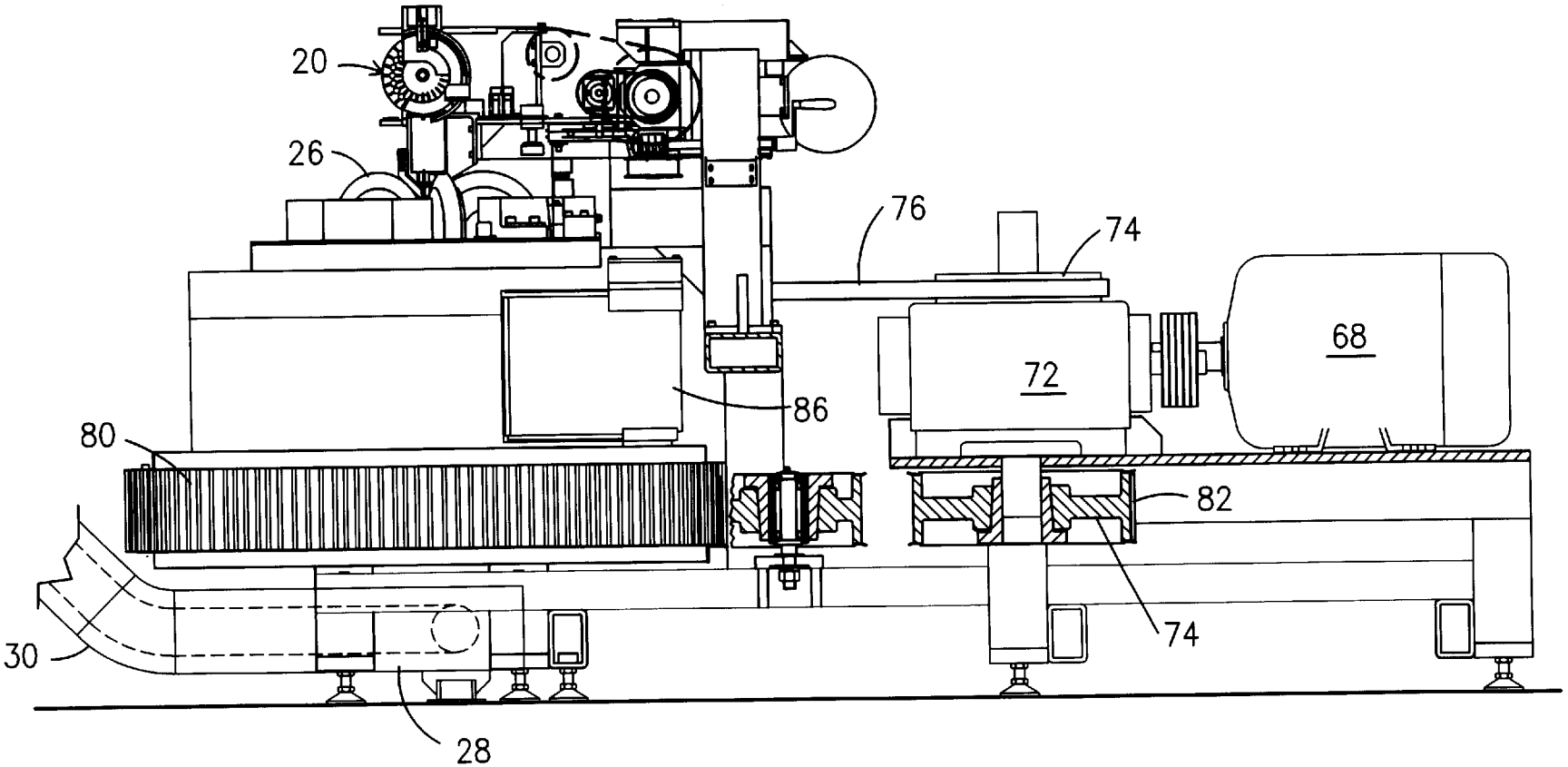
FIG. 12 is a sectional view taken along line 12—12 in FIG. 2.

The means for rotating form rollers 26 and for maintaining them in phase with one another is depicted in FIGS. 10–12 and will be disclosed in detail hereinafter.

Returning now to FIGS. 3 and 3*a*, there it will be seen that novel nail accelerator means 18, like discharge chute 16, is formed primarily by a pair of substantially parallel plates, collectively denoted 34, that are spaced from one another by a distance slightly greater than a diameter of a nail shank. An air passageway 36 is formed in each plate 34 and is angled so that air flowing through each passageway is applied to the trailing side of each nail, blowing it away from discharge chute 16 and toward indexer means 20 as indicated by single-headed directional arrow 37. A suitable air compressor means, not shown, is employed to provide the required operable volume of air flow. Accelerator means 18 has a hingedly mounted part 38 that swings about hinge 40 if a bent nail enters into accelerator means 18; a microswitch 42 is mounted in close proximity to said hinged part 38 so that when said part swings about hinge 40, microswitch 42 is activated. Once activated, switch 42 sends a signal to the control means of machine 10 and shuts it down so that the bent nail can be removed from accelerator means 18 by a machine operator.

Figures 3A, 4:
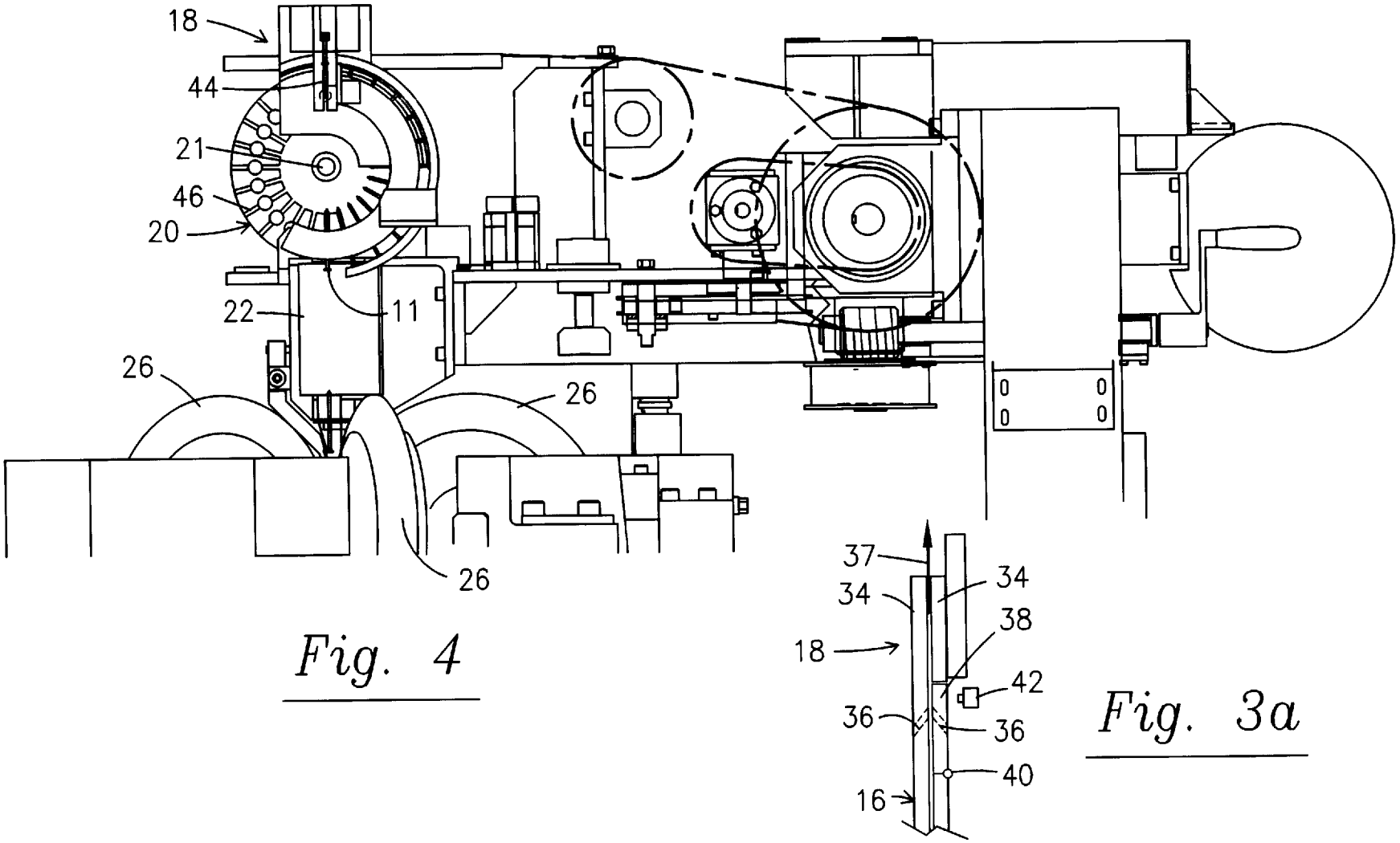
FIG. 3*a* is an enlarged top plan view of the novel nail accelerator means positioned at the left end of FIG. 3.
FIG. 4 is a front elevational view of the novel indexer means.
Figure 5:
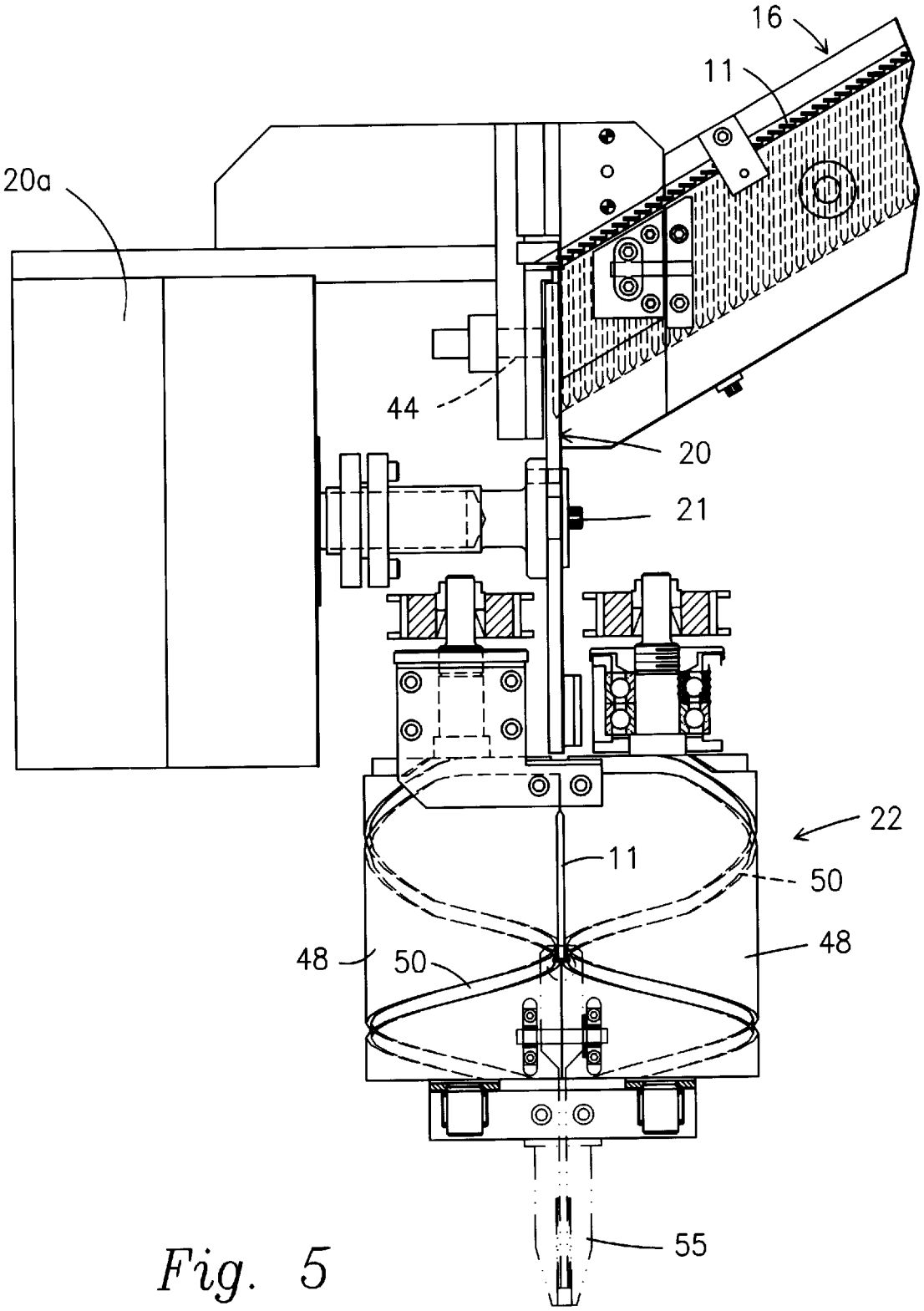
FIG. 5 is a front elevational view of the novel transfer means.

As depicted in FIGS. 4 and 5, a magnet 44 of suitable strength is positioned on the rearward side of indexer means 20, in alignment with the discharge end of accelerator means 18. Thus, as compressed air blows a nail toward the indexer means, the magnetic force of magnet 44 pulls said nail toward the same location.

Indexer 20, which is mounted for rotation about an axis of rotation, includes a drive means 20*a* (FIG. 5) and a plurality of nail-holding slots 46 (FIG. 4); the number of slots is a matter of design choice. Slots 46 are positioned radially with respect to said axis of rotation. A nail entering the indexer from accelerator 18 is positioned at the 12:00 position, with its head above its point; as the indexer operates, the nail is gradually inverted, i.e., when it arrives at the 6:00 position, its point is above its head. Significantly, the head of the inverted nail will extend a short distance from the indexer so that novel transfer means 22 can engage the head and transfer the nail from the indexer to the form roller station.

The novel transfer means 22, as depicted in FIGS. 4 and 5, is provided in the form of a pair of upstanding cylindrical members, collectively denoted 48, mounted for rotation about their respective vertical axes. A substantially helical groove 50 is formed in each cylinder 48, and extends from a top or receiving end thereof to a bottom or discharge end thereof as depicted. As the cylinders, hereinafter referred to as augers due to said helical grooves 50, rotate about their respective vertical axes, the head of a nail protruding downwardly from indexer 20 is engaged by the respective uppermost ends of said grooves 50. Thus, rotation of augers 48 draws the head of the nail in a downward direction.

Figure 6:
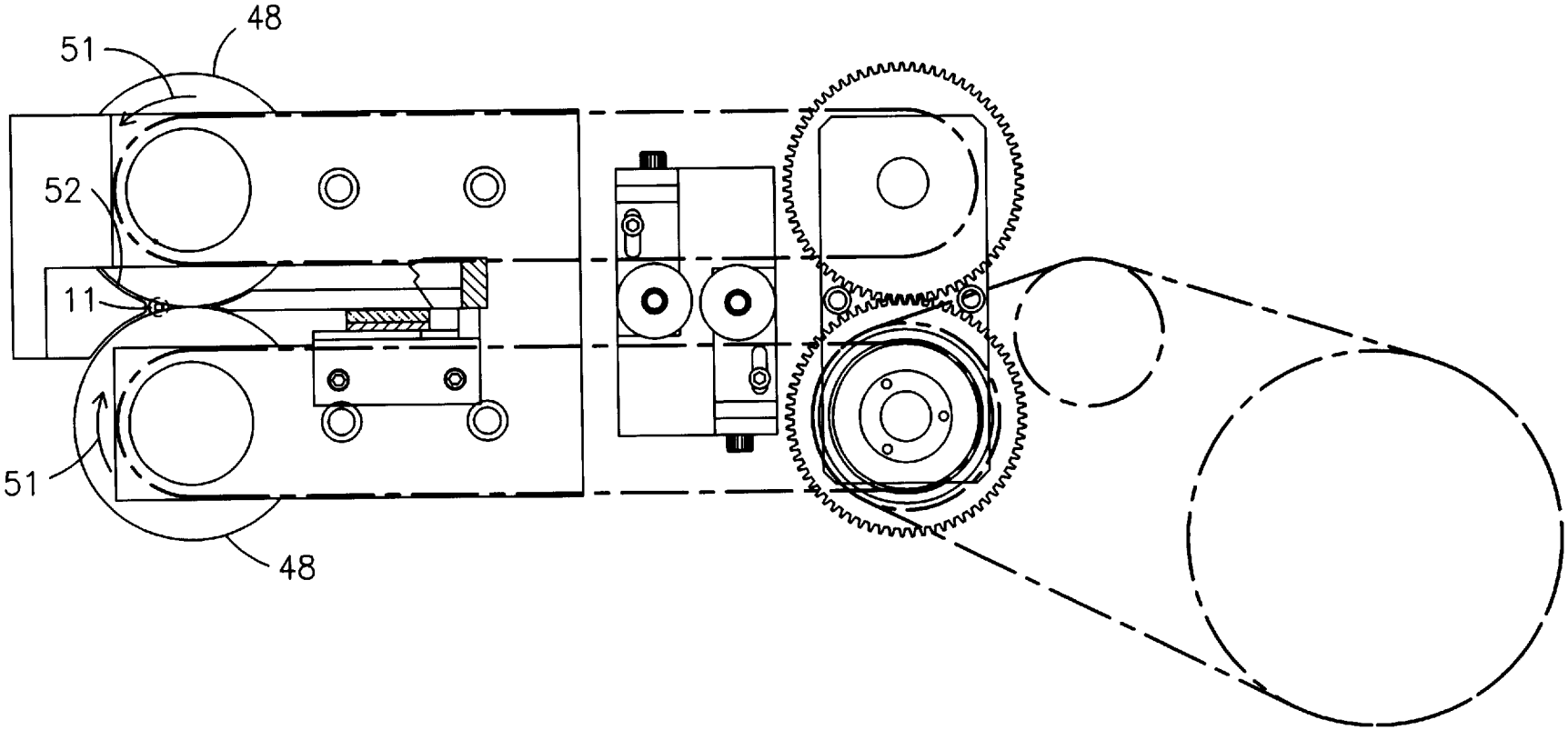
FIG. 6 is a top plan view of said transfer means.

As best understood in connection with FIG. 6, each nail is not positioned in line with the respective axes of rotation of said augers 48, but is offset therefrom by a predetermined amount. A nail retainer 52 is positioned forwardly of the augers in containing relation to the nail as depicted; it performs the function its name expresses. Without retainer 52, rotation of the augers would propel the nail away from said augers; with the retainer, the nail is constrained to follow a downwardly directed path, i.e., a path away from indexer 20 and towards the form roller station.

The direction of rotation of augers 48 is indicated by single-headed directional arrows 51 in FIG. 6; thus it will be understood that retainer 52 would be placed on the opposite side of augers 48 if said augers were rotated in an opposite direction.

It will be observed that helical grooves 50 cannot advance the nailhead beyond the lowermost end of said grooves, i.e. beyond the discharge end of the augers. Accordingly, the common extent of augers 48 is selected such that a second nail begins its downward traverse through helical grooves 50 before the first nail is discharged therefrom, i.e., said common extent is greater than the extent of a nail but less than the combined extent of two nails. Thus, there are always two nails in transfer station 22; the head of the second or trailing nail abuts the point of the first or leading one and displaces it, i.e., the trailing nail displaces the leading nail a predetermined extent so that the head of the leading nail is positioned in spaced relation downwardly from the lowermost end of grooves 50.

As a leading nail is driven out of the transfer station 22 by a trailing nail, said leading nail enters into a receiving end of a nail-gripping station 24 (FIG. 7) which is positioned adjacent the discharge end of said augers. Station 24 is defined by a chute 55, which supports and guides said leading nail to the discharge end of station 24, and a rigid finger 54, which is hingedly mounted as at 56 and biased radially inwardly by a bias means 58 so that said finger converges into the open passage of the chute 55. As a leading nail is driven from transfer station 22 by a trailing nail, the head of said leading nail transiently overcomes bias means 58 so that said head can pass through nail-gripping means 24. As soon as the head of said leading nail has passed through said gripping means, bias means 58 causes finger 54 to converge onto the shank of said nail, so that the nail is gripped by the shank with its head protruding a predetermined distance downwardly from the gripping means.

Figure 7:
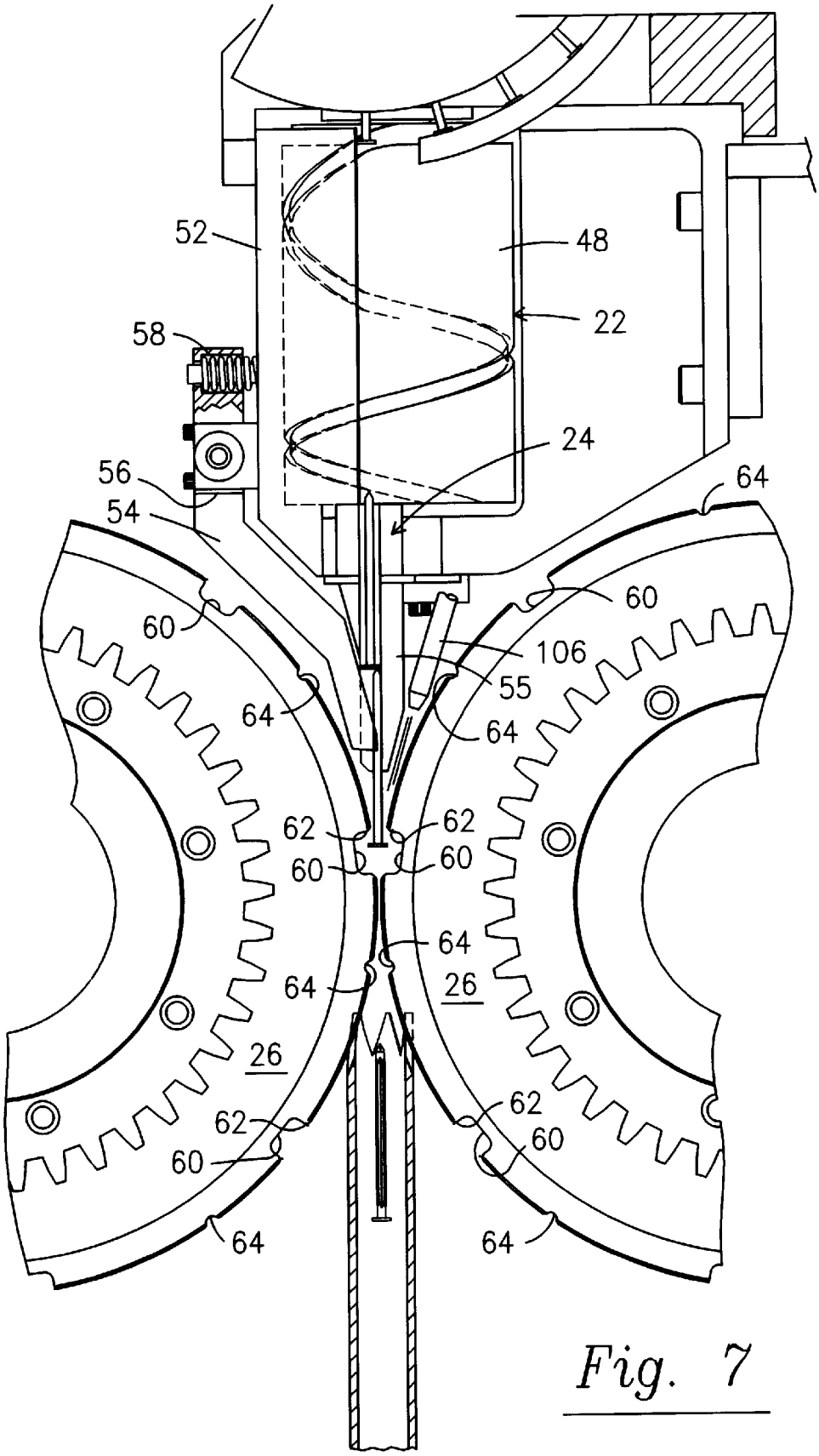
FIG. 7 is a side elevational view of the novel nail gripping means.

As indicated in FIG. 7, when the nailhead has attained its lowermost position, it is simultaneously engaged and pulled downward by a plurality of notches, collectively denoted 60, formed in form rollers 26. More particularly, there is a plurality of circumferentially and equidistantly spaced nail head-receiving notches 60 formed in the periphery of each form roller. Form rollers 26 are equidistantly and circumferentially spaced about the same vertical axis of the nail as it is held by gripping means 24, and they rotate in phase with one another so that the notches simultaneously engage the nailhead at equidistantly and circumferentially spaced locations about the periphery of the nailhead. This ensures that each nail is pulled downwardly into the forming station along its centerline.

A bevel 62 is formed adjacent each notch 60 so that a short extent of the nail, immediately adjacent the head, is not formed by the form rollers. Moreover, a concavity 64 is formed in each form roller a predetermined circumferential extent from each notch; this enables the work-hardened point of each nail to escape forming. The resulting nail is depicted in elevational view in FIG. 8 and in transverse section in FIG. 9.

Concavity 64 was not provided in the form rollers of the prior art, with the result that the work-hardened point of each nail was formed in the same way as the shank. This caused cracking in the form rollers and also destroyed the work-hardened point of the nail.

Figure 9:
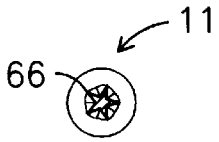
FIG. 9 is a sectional view taken along line 9—9 in FIG. 8.

The five form rollers are spaced apart with respect to one another by a distance less than the diameter of the shank of the conventional nails sequentially fed therebetween. Thus, some of the material in the shank of the nail is squeezed out of the shank and is constrained to flow into five equidistantly and circumferentially spaced apart, radially extending, tapered fins 66 (FIGS. 9 and 10).

The head of each nail is positioned within its associated notch 60 throughout the entire forming process so that the head is not formed. Note that from the moment the nail is inverted by indexer 20, it travels downwardly in coincidence with its longitudinal axis of symmetry. Each nail is released as its work-hardened point enters into concavity 64, thereby escaping formation as aforesaid; the nail drops under the force of gravity into collection means 28 of any suitable type, to be carried by conveyor means 30 of any suitable type to packing station 32 as depicted in FIG. 1.

Referring further to FIGS. 1–3, power for operating machine 10 is provided by a motor means 68 having an output shaft 70 connected to a gear reducer 72. The gear reducer has a first power take-off shaft 74 (see FIG. 3 also) that operates indexer 20 through a suitable drive means such as toothed belt 76, and a second power take-off shaft 78 (FIG. 3) that rotates a large ring gear 80 (FIG. 2) through a suitable drive means such as toothed belt 82. Large ring gear 80 is centered on the longitudinal axis of symmetry of the inverted nails.

Rotation of large ring gear 80 effects simultaneous rotation of five fixed position, rotatably mounted spur gears, one of which is depicted in FIG. 10 and denoted 84, that are equidistantly and circumferentially positioned about the inner side of ring gear 80 in meshing engagement therewith. As indicated in FIG. 10, an idler gear 81 translates rotation of said ring gear into rotation of each of said spur gears 84. The meshing teeth of idler gear 81 and each spur gear 84 have a predetermined extent so that the meshing occurs along a predetermined vertical extent; this enables spur gears 84 to be raised and lowered with respect to their respective idler gears 81 and thus with respect to ring gear 80 without mutual disengagement.

As best understood in connection with FIG. 10, each spur gear 84 rotates about its vertical axis of rotation and engages an elongate upstanding worm gear 86 that also rotates about a vertical axis of rotation, and each worm gear 86 meshingly engages another spur gear 88 that is keyed to a first end of a horizontal shaft 90; accordingly, rotation of spur gear 88 effects simultaneous and corresponding rotation of horizontal shaft 90. Another spur gear 92 is keyed to the second end of horizontal shaft 90, and said second spur gear 92 meshingly engages an intermediate gear 94 that meshingly engages gears 96, 98 that are secured to each form roller 26 in sandwiching relation thereto for concomitant rotation therewith. Note form FIGS. 10 and 11 that a form roller-accommodating groove 100 is formed in each intermediate gear 94 so that each gear 94 meshingly engages its associated form roller sandwiching gear 96, 98.

As those skilled in the mechanical arts will appreciate, displacing a worm gear 86 along its vertical axis of rotation affects the instantaneous rotational position of its associated form roller 26. Displacement of each worm gear 86 is achieved by hand-cranking handle 102 (FIG. 10); in this way, a form roller 26 that is out of rotational phase with the other form rollers is easily brought back into rotational phase therewith.

Considerable heat is generated during the forming process, so cooling of the form rollers is important. In a preferred embodiment, a coolant from a source 104 (FIG. 2) is delivered by a main hose 105 to a nozzle 106 (FIG. 7) positioned at the radially inwardmost end of each form roller 26. A suitable pump means 109 is employed to effect flow of said coolant through said main hose 105. The coolant is recycled and used again as it drops, from the forming station, under the influence of gravity and is naturally cooled as it falls into a collection tank 107 equipped with a suitable sump pump, not shown, to maintain the circulation of such coolant. The return line to the source of coolant is denoted 111 in FIG. 2.

Figure 8:
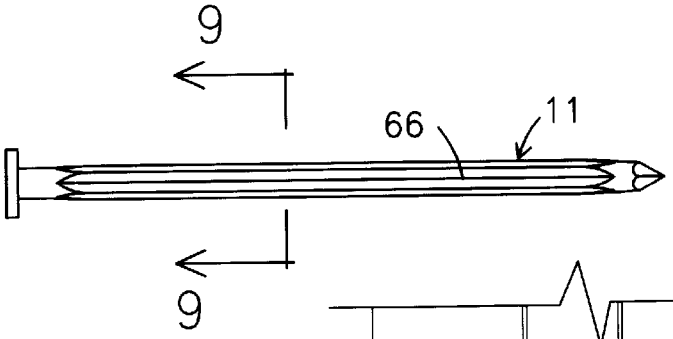
FIG. 8 is a side elevational view of a novel nail made by the novel machine.

The novel machine thus takes conventional nails and transforms them into the five-finned star nails of FIGS. 8 and 9. The machine produces said star nails at an economically acceptable rate and operates for extremely long periods of time with minimal downtime. Moreover, the form rollers have an extended lifetime. Thus, the completely re-designed machine of this invention overcomes all of the limitations of its predecessor machine.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A machine for making nails having a star-shaped transverse cross-section, said machine including a bowl feeder that performs a hopper function and that delivers nails having flat heads and a substantially circular transverse cross section in sequential fashion to a nail discharge station, comprising:

a discharge chute disposed between said bowl feeder and an indexer means for delivering nails in single file to the indexer means;

a nail accelerating means for delivering nails from said discharge chute to said indexer means, said nail accelerating means positioned between said discharge chute and said indexer means;

said nail accelerating means including a pair of substantially parallel plates spaced apart from one another by a distance slightly greater than a diameter of a nail shank;

an air passageway formed in each plate of said substantially parallel plates, said air passageway being angled toward said indexer means so that pressurized air flowing therethrough provides a positive pressure behind a nail positioned between said substantially parallel plates thereby propelling the nail toward said indexer means;

the indexer means adapted to releasably and simultaneously engage a plurality of nails discharged by said discharge station;

said indexer means adapted to sequentially receive said nails in a first upright position and to invert said nails into an inverted position where respective heads thereof are positioned below respective points thereof, the indexer means further being mounted for rotation about an axis of rotation;

the indexer means further including a plurality of nail-receiving slots that are radially disposed with respect to said axis of rotation;

the indexer means further including a nail-receiving end and a nail-discharging end that are one hundred eighty degrees apart form one another;

a forming station including a plurality of rotatably mounted form rollers positioned in downwardly spaced relation to said indexer means;

a transfer means for displacing each nail away from said indexer means and delivering each nail to said forming station;

each form roller of said plurality of rotatably mounted form rollers having a plurality of circumferentially spaced apart nail head-receiving notches formed in its periphery to engage a head of each nail delivered to said forming station by said transfer means and to pull each nail into forming relation with said plurality of rotatably mounted form rollers;

each form roller further including a plurality of concavities formed in a periphery of each form roller in circumferentially spaced relation to said nail head-receiving notches, said concavities receiving work-hardened points of said nails to prevent said work-hardened points form being formed by said form rollers;

each form roller further including a bevel formed in the periphery of each form roller adjacent each nail head-receiving notch so that a short extent of each nail, adjacent its head, is not formed by said form rollers;

a nail collection means positioned below said forming station;

a motor means for operating said machine;

a drive means for interconnecting said indexer means and said motor means;

and a cooling means for cooling said form rollers;

whereby a nail having a formed shank drops into said collection means under the force of gravity when it is released by said plurality of forming rollers.

2. The machine of claim 1 wherein said nail accelerator means further comprises:

a magnet positioned behind said indexer means, said magnet being in alignment with a discharge end of said nail accelerator means so that a nail propelled by air toward said indexer means is simultaneously pulled toward said indexer means by a magnetic force field produced by said magnet.

3. The machine of claim 1, wherein said nail accelerator means further comprises:

a hinged portion formed in a preselected plate of said substantially parallel plates for access to remove bent nails;

a bias means for maintaining said hinged portion in a position of repose so as to maintain said plates, including the hinged portion on the preselected plate, substantially parallel to one another;

a switch means juxtaposed the hinged portion of said preselected plate;

a control means for operating said machine;

said switch means being in communicating relation to said control means;

whereby a bent part of a bent nail positioned within said accelerator means overcomes a bias provided by said bias means and causes said hinged portion of said preselected plate to swing and contact the switch means, thereby activating said switch means and causing said control means to shut down said machine.

4. The machine of claim 1, wherein said transfer means includes a pair of rotatably mounted cylindrical augers having a common predetermined extent and having substantially spiral grooves formed in respective cylindrical surfaces thereof, said augers having a receiving end mounted in closely spaced relation to said discharge end of said indexer means, said grooves engaging a head of a nail in said indexer means when said nail is in an inverted position where its head is below its point, and said head of said nail being constrained to advance along an extent of said augers as said augers rotate about their respective axes of rotation, said head of said nail exiting said augers at a discharge end thereof.

5. The machine of claim 4, wherein said common predetermined extent of said augers is greater than the extent of a nail and less than a combined extent of two nails, and wherein a head of a trailing nail entering said helical groove pushes against a point of a leading nail to drive a head of said leading nail beyond the discharge end of said augers by a predetermined extent.

6. The machine of claim 5, further comprising a nail retainer means positioned in predetermined spaced relation to said augers and in containing relation to said nail.

7. The machine of claim 1, further comprising a nail-gripping means having a receiving end positioned adjacent said discharge end of said augers and a discharge end longitudinally spaced therefrom, said nail gripping means including a chute and a nail-gripping finger, which said finger is biased in a radially inward direction so that it converges into the chute to grip a shank of a nail driven into said nail gripping means by said augers, and wherein a head of a nail having a shank gripped by said nail gripping means extends beyond said discharge end of said augers.

* * * * *